United States Patent [19]

Kishi et al.

[11] Patent Number: 4,795,325

[45] Date of Patent: Jan. 3, 1989

[54] COMPRESSOR OF ROTARY VANE TYPE

[75] Inventors: Atsuo Kishi; Masao Mizukami, both of Katsuta, Japan

[73] Assignee: Hitachi, Ltd., Tokyo, Japan

[21] Appl. No.: 437,673

[22] Filed: Oct. 29, 1982

[30] Foreign Application Priority Data

Oct. 30, 1981 [JP] Japan ..... 56-172731

[51] Int. Cl.[4] ..... F02C 21/04

[52] U.S. Cl. ..... 418/87; 418/76; 418/77; 418/93

[58] Field of Search ..... 418/83, 87, 93, 96, 418/97, 98, 99, 76, 77

[56] References Cited

U.S. PATENT DOCUMENTS

| | | | |
|---|---|---|---|
| 1,237,668 | 8/1917 | Machlet | 418/269 |
| 1,684,395 | 9/1928 | Hapgood | 418/91 |
| 2,070,662 | 2/1937 | Johnson | 418/91 |
| 2,653,550 | 9/1953 | Gardiner et al. | 418/077 |
| 2,696,787 | 6/1948 | Jaworowski et al. | 418/269 |
| 2,827,226 | 3/1952 | McCormack | 418/93 |
| 3,059,585 | 10/1962 | Froede et al. | 418/61 A |
| 4,408,969 | 10/1983 | Takada | 418/98 |
| 4,415,321 | 11/1983 | Okazaki | 418/179 |

*Primary Examiner*—Allen M. Ostrager

*Attorney, Agent, or Firm*—Antonelli, Terry & Wands

[57] ABSTRACT

A compressor of the rotary vane type including an annular space dormed inside a rotor for communicating vane slots formed in the rotor in communication with one another and for storing lubricant therein. As vanes each received in one of the vane slots move in radial sliding reciprocatory movement in the respective vane slots, the vanes are lubricated at their surfaces by the lubricant.

4 Claims, 2 Drawing Sheets

COMPRESSOR OF ROTARY VANE TYPE

BACKGROUND OF THE INVENTION

This invention relates to compressors of the rotary vane type, and more particularly to improvements in a lubricating mechanism for rotary vane type compressors.

Generally a compressor of the rotary vane type comprises a rotor formed with a plurality of vane slots arranged radially for receiving therein vanes for movement in and out of the vane slots. As the rotor rotates within a cam cylinder, the vanes move radially in the respective vane slots in sliding reciprocatory movement to maintain the forward ends of the vanes in sliding contact with an inner peripheral surface of the cam cylinder at all times.

By the aforesaid arrangement, compression working chambers defined by an outer peripheral surface of the rotor, the inner peripheral surface of the cam cylinder, end plates sealing axial end portions of the cam cylinder and the vanes have their volumes varied as the rotor rotates, so that a fluid can be compressed and discharged by utilizing the difference in the volume of each compression working chamber.

Generally the rotor of a compressor of the type described is constructed by one of the two following processes: a rotary shaft and a rotor body are formed integrally of a ferrous material by machining or the rotary shaft and the rotor body are formed of a ferrous material as two separate entities by machining and made into a unitary structure by force fitting the former into the latter.

The rotor is formed with a plurality of vane slots arranged radially about the rotary shaft extending through the center of the rotor and located equidistantly from one another each for receiving therein one of the vanes for sliding reciprocatory movement.

An annular groove is formed at each of opposite ends of the rotor in a position in which the lower ends of the vane slots are located for maintaining the vane slots in communication with one another at their lower ends.

One of the end plates sealing the axial end portions of the cam cylinder is formed with oil passages communicating with a high pressure chamber formed on a side of the end plate opposite the side thereof on which the cam cylinder is located for supplying oil under high pressure to the annular grooves.

The oil fed into the annular grooves fills the bottom portions of the vane slots to apply a predetermined pressure to the lower end faces of the vanes in the vane slots.

The oil flows radially outwardly from the bottom portions of the vane slots and passes through a clearance between each vane and an inner wall of each vane slot to lubricate same, before flowing into the working chambers.

Heretofore, lubrication of the vanes and the inner wall surfaces of the vane slots has been effected only by the oil fed through the annular grooves on opposite ends of the rotor. Thus, rotary vane compressors of the prior art have had the disadvantage that when the pressure of the oil is low or its volume is small it is impossible to effect satisfactory lubrication of these parts.

SUMMARY OF THE INVENTION

An object of this invention is to provide a compressor of the rotary vane type provided with a lubricating mechanism enabling lubrication of the vanes and the inner wall surfaces of the vane slots to be effected satisfactorily.

Another object is to provide a compressor of the type described having a rotor of light weight.

One of the outstanding characteristics of the invention is that a space is defined inside the rotor for maintaining the vane slots in communication with one another which stores therein a body of lubricant so that the vanes will move across the space when they move in radial sliding reciprocatory movement and be lubricated at opposite sides by the lubricant in the space.

Another outstanding characteristic is that the rotor is composed of a plurality of sections into which the rotor is divided in suitable positions, to thereby enable the space inside the rotor for storing a body of lubricant to be readily formed.

Still another outstanding characteristic is that the space inside the rotor for storing a body of lubricant is constructed such that the rearward ends of the vanes are immersed in the lubricant in the space inside the rotor even when each rotor is located in a radially outermost position during its radial sliding movement.

DETAILED DESCRIPTION OF THE PREFERRED EMBODIMENT

The embodiment of the compressor of the rotary vane type in conformity with the invention is suitable for use with an air conditioning system for automotive vehicles, with the compressor being driven by an engine of the automotive vehicle.

Figure 1:
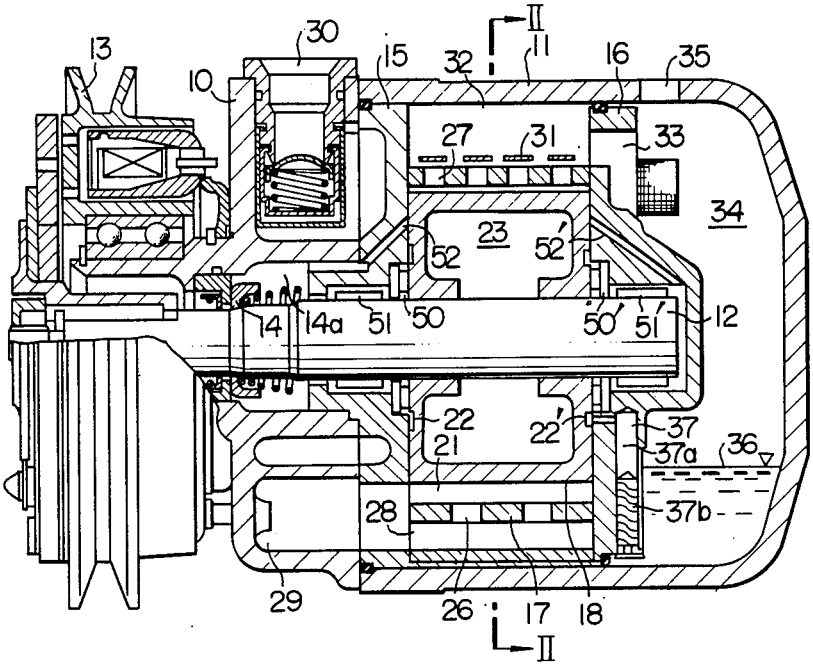
FIG. 1 is a vertical sectional view of the compressor of the rotary vane type comprising one embodiment of the invention.

Referring now to the drawings wherein like reference numerals are used throughout the various views to designate like parts and, more particularly, to FIG. 1, according to this figure, a compressor comprises a front cover 10 and a casing 11 defining a chamber, and a shaft 12 extending through the central portion of the chamber and penetrating at one end portion thereof, through a seal 14, the front cover 10 for supporting a pulley 13 which is driven by the engine. The shaft 12 is rotatably supported through bearings by side covers 15 and 16 located in the chamber defined by the front cover 10 and the casing 11 and spaced apart from each other a predetermined distance to define, between the side covers 15 and 16 and an inner peripheral surface of the casing 11, a compartment for containing a cam cylinder 17 attached to the inner peripheral surface of the casing 11. The cam cylinder 17 has arranged therein a rotor generally designated by the reference numeral 18 mounted on the shaft 12, with the rotor 18 having an outer peripheral surface which is circular in circumference and formed with equidistantly spaced radially extending vane slots 19 each receiving a vane 20 for sliding reciprocatory movement therein. The cam cylinder 17 has an inner peripheral surface of an epitrochoid form cooperating with an outer peripheral surface of the rotor 18 to define a plurality of working chambers 21 (two in number in this embodiment). The working chambers 21 are closed by the side covers 15 and 16 and each divided into a plurality of compression chambers by the vanes 20.

Figure 2:
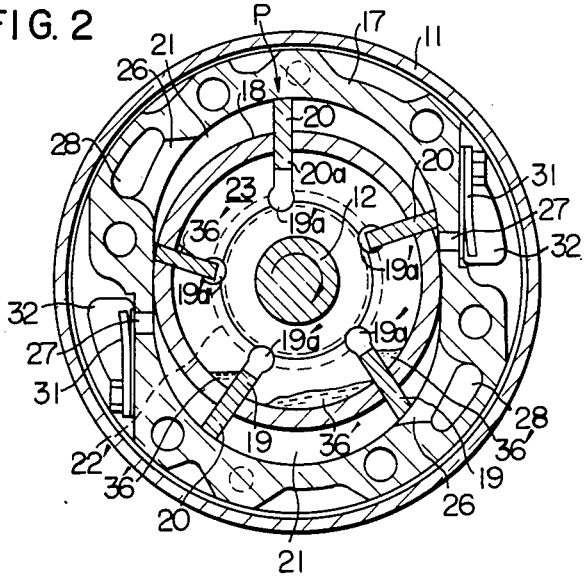
FIG. 2 is a sectional view taken along the line II—II in FIG. 1.
Figure 3:
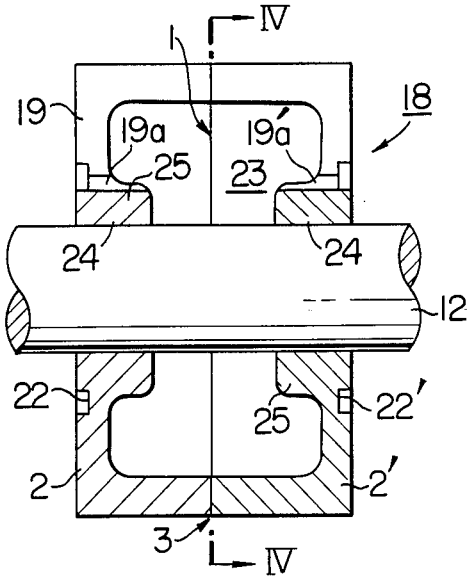
FIG. 3 is a sectional view of the rotor of the compressor shown in FIG. 1.
Figure 4:
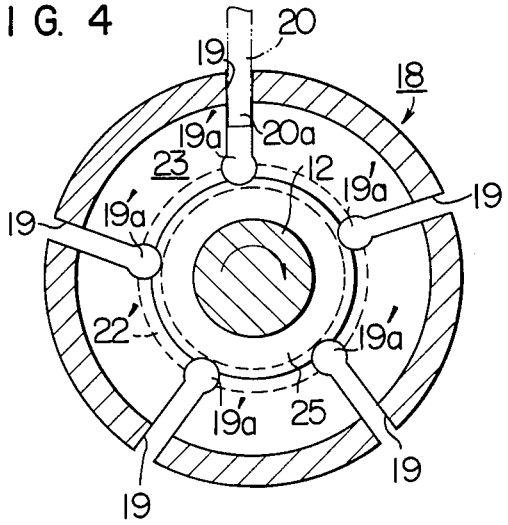
FIG. 4 is a sectional view taken along the line IV—IV in FIG. 3.

As shown in FIGS. 3 and 4, the rotor 18 is formed of cap-shaped rotor half-bodies 2 and 2' abutted against each other at an interface 1 to provide a unitary structure to form inside the rotor 18 an annular space 23 around the shaft 12. The rotor half-bodies 2 and 2' are formed by a powder metallurgical process each into a cap shape and have an opening 24 for inserting the shaft 12 and the vane slots 19. The rotor half-bodies 2 and 2' are sintered at an abutting end face 3 as by a diffusion process and shaped into the rotor 18. The rotor 18 includes a shell surrounding the space 23 having a thickness such that when each vane 20 reaches a radial outermost position P at FIG. 2 in which the distance between the center Q of the shaft 12 and the inner peripheral surface of the cam cylinder 17 is maximized, a rear end portion of the vane 20 slightly extends into the annular space 23. The annular space 23 formed inside the rotor 18 allows the vane slots 19 to communicate with one another within the rotor 18 and contains a body of lubricant for applying back pressure to the vanes 20 in the vane slots 19 and lubricating same, so as to apply a back pressure of a predetermined level to all the vanes 20. The rotor 18 is connected to the shaft 12 by, for example, force fitting to rotate therewith as a unit. Each of the rotor half bodies 2 and 2' is formed with a boss 25 of increased thickness to provide an allowance for force-fitting. In this embodiment, the bosses 25 of the rotor half-bodies 2 and 2' are spaced apart from each other to expose the shaft 12 to the annular space 23. This arrangement is not essential and the bosses 25 may, of course, be increased in length so that they are connected together to separate the shaft 12 from the annular space 23.

As the rotor 18 rotates, the working chambers 21 defined by the cam cylinder 17, rotor 18 and side covers 15 and 16 have their volumes varied. The cam cylinder 17 is formed with suction ports 26 for drawing a refrigerant in a gaseous state by suction into the working chambers 21 and discharge ports 27 for discharging same therefrom. The suction ports 26 are communicated with suction passages 28 formed in the cam cylinder 17 which, in turn, are communicated with a suction chamber 29 defined between the front cover 10 and the side cover 15. Thus, the refigerant in a gaseous state is introduced through a suction inlet 30 into the working chambers 21 via the suction chamber 29, suction passages 28 and suction ports 26. Meanwhile the discharge ports 27 are communicated through discharge valves 31 with discharge passages 32 formed on the outer surface of the cam cylinder 17 and communicated, through discharge apertures 33 formed in the side cover 16, with a chamber 34 located on a side of the side cover 16 opposite the side thereof adjacent the cam cylinder 17.

The chamber 34 contains a lubricant 36 to be supplied to various sliding parts of the compressor. The lubricant 36 is fed by utilizing compressed gas pressure to the annular space 23 through lubricant passages 37 and 37' formed in the side cover 16, annular grooves 22 and 22' formed in the rotor 18 and vane slots 19.

A screw **37*b* mounted in the lubricant passage 37 functions as a throttle for restricting the flow rate of the lubricant through the lubricant passage 37 to prevent more lubricant than is necessary from being fed into the vane slots 19** even if the pressure of the lubricant rises.

In normal operation condition, lubricant under a predetermined pressure is contained in the annular space 23. As the rotor 18 rotates, the vanes 20, moving in reciprocatory sliding movement in a radial direction in the respective vane slots 19, move across the annular space 23 filled with the lubricant, so that the sliding surfaces on the inner wall surface of each slot 19 and the sides of each vane 20 are lubricated by the lubricant deposited on the sides of the vane 20.

Following lubrication, the lubricant flows into the working chambers 21 and is discharged into the chamber 34 together with the compressed refrigerant in a gaseous state through the discharge ports 27 and discharge apertures 33. The lubricant in the refrigerant is separated therefrom by oil separating means, not shown, located in the chamber 34 and collected in a lower portion of the chamber 34. Meanwhile, the refrigerant is discharged through the discharge outlet 35 for circulation through the refrigeration cycle.

The lubricant 36 stored in the lower portion of the chamber 34 is led by the gas pressure in the chamber 34 to the annular groove 22' at one end face of the rotor 18 through the passages 37 and **37*a* while having its flow rate controlled by the screw 37*b*. Part of the lubricant is led through bottom openings 19*a* of the vane slots 19 communicating with the annular groove 22' into the annular space 23 to supplement the annular space 23 for the volume of lubricant flowing therefrom to a lubricant circulating channel on the front side or the other end face of the rotor 18**, as subsequently to be described.

Part of the lubricant led to the annular groove 22' is supplied to a sliding interface between the rotor 18 and the side cover 16 through a thrust bearing 50' mounted in the side plate 16 for bearing the axial thrust applied to the rotor 18 and a needle bearing 51' mounted in the side cover 16 for journalling the shaft 12 and via a lubricant passage 52' formed in the side cover 16.

The thrust bearing 50', needle bearing 51' and the rear end face of the rotor 18' are lubricated by the lubricant flowing through the rear side lubricant circulating channel. The lubricant is discharged into one of the working chambers 21 after flowing through a gap between the rotor 18 and side cover 16, following lubrication.

The lubricant in the annular space 23 flows into the annular groove 22 formed at the front end face of the rotor 18 through the front side bottom openings **19*a* of the vane slots 19. The lubricant in the annular groove 22 flows into a shaft seal chamber 14*a* through a thrust bearing 50 and a needle bearing 51 secured in the front side cover 15. The oil in the shaft seal chamber 14*a* is fed through an oil passage 52 formed in the side cover 15 into a gap between the rotor 18 and side cover 15**.

The thrust bearing 50 and needle bearing 51 on the front side and the front end face of the rotor 18 are lubricated by the lubricant flowing through the front side lubricant circulating channel. The lubricant is also utilized for the shaft seal 14.

When the compressor is inoperative, the oil in the annular space 23 flows, by its own weight, through gaps between the vane slots 19 and the vanes 20 into the working chamber 21 located perpendicularly below the annular space 23, thereby leaving a small amount of lubricant in the annular space 23.

As the rotor 18 rotates in the direction of an arrow in FIG. 2 after the compressor is started, the oil remaining in the annular space 23 flows in drops into the lower portion of the chamber 34 through the discharge ports 27, discharge passages 32 and discharge apertures 33. The lubricant in the chamber 34 is ejected through the bottom openings 19a' of the slots 19 into the annular space 23 as described hereinabove.

The amount of lubricant supplied to the annular space 23 in this condition is set at five to ten times as great as the amount of lubricant flowing from the gaps between the vanes 20 and the vane slots 19 into the working chamber 21. Thus, the annular space 23 with a capacity of 30 cc is filled with lubricant about three minutes after the compressor is started (at a constant rotational speed of 2000 rpm). Until the annular space 23 is filled with lubricant, back pressure is not applied to the vanes 20 and the forward ends of the vanes 20 are caused to press against the inner wall surface of the cam cylinder 17 solely by the centrifugal forces acting on the vanes 20. As a result, when the internal pressure of the working chamber 21 rises above a predetermined level, the vanes 20 are pushed back relatively easily toward the shaft 12 to bring the adjacent compression chambers into communication with each other and keep the discharge pressure from abruptly rising.

This phenomenon has a sort of unloader effect at compressor startup and contributes to lessening of a starting torque.

After a lapse of three minutes, a back pressure is applied to the vanes 20 by the lubricant supplied from the annular space 23, so that the unloader effect spontaneously disappears.

In the embodiment described hereinabove, a refrigerant of low temperature is by suction through the front side cover 15 and discharged in high temperature through the rear side cover 16. However, with lubricant of high temperature being filled in the annular space inside the rotor 18, the rotor 18 has a uniform temperature distribution and as a result its thermal deformation occurs evenly. The rotor 18 should have a circular outer periphery in relation to the cam cylinder 17, innumerable benefits are obtained by providing for a uniform temperature of the rotor 18 being rendered.

Moreover, the rotor 18 is in the form of a shell defining the annular space 23, so that the weight of the rotor 18 is about one-half that of rotors of the prior art. The provision of the annular space 23 serving as a passage for maintaining the vane slots 19 in communication with one another increases the cross-sectional area of the channel by about eightfold as compared with the prior art in which communication between the vane slots are maintained only through grooves connecting the bottom openings of the slots together. Thus, the invention can achieve excellent effects in reducing the weight of the compressor, and a flow loss of the lubricant caused by the reciprocatory movement of the vanes 20. In this type of compressor, the speed of the reciprocatory sliding movement of the vanes 20 reaches a maximum of 8 m/s when the rpm of the rotor is 7000, so that the compressor usually suffers a channel loss due to the flow of lubricant and a frictional loss in internal sliding parts. In the invention, the use of the annular space 23 reduces the flow velocity of the lubricant to about one-eighth the aforesaid value and the flow losses can be minimized.

The area of the sides of the vanes 20 and slots 19 coming into sliding contact with each other is reduced and a mechanical loss caused by the frictional dragging of the vanes on the walls of the slots can be minimized.

While the rotor 18 has been described as being produced by a power metallurgical process, the invention is not limited to this specific production process of the rotor and the rotor may be produced by any suitable process, such as by forging and joining the parts by welding.

FIG. 2 shows the condition of lubricant immediately after the compressor is started and the lubricant is designated by the reference numeral 36'. Even if the amount of the lubricant 36' is small as when the compressor is started, lubricant is present between the opposite sides of the vanes 20 and the inner wall surface of the space 23, to enable lubrication of the vanes 20 to be smoothly carried out.

What is claimed is:

1. A compressor of a rotary type comprising:

a cam cylinder;

a pair of side covers;

a rotor located in a space defined by said cam cylinder and said pair of side covers;

a plurality of radially extending vane slots formed in said rotor;

a plurality of vanes each inserted in one of said plurality of vane slots for reciprocatory sliding movement, said vanes being maintained in a sliding contact with an inner peripheral surface of said cam cylinder to define between the vanes, cam cylinder, rotor and side vanes a plurality of compression chambers, said plurality of compression chambers receiving a fluid drawn therein by suction for compression as the volumes of said compression chamber undergo changes during a rotation of said rotor;

a high pressure chamber located on one side of one of said pair of side covers for storing therein lubricant separated from a compressed refrigerant;

an annular space formed inside said rotor for maintaining said vane slots in communication with one another such that said slots are positioned perpendicular to said annular space whereby said annular space is in contact with the bottom openings of said vane slots, said annular space containing a lubricant for lubricating surfaces of said vanes;

lubricating supply passage means formed in said one side cover for communicating said high pressure chamber with said annular space; and means provided in said lubricant supply passage means for enabling an unloading of the compressor during a start-up so as to reduce the starting torque of the compressor.

2. A compressor of the rotary vane type as claimed in claim 1, wherein said rotor includes a peripheral wall of a thickness such that when each of said vanes is in a radial outermost position a rear end portion of said vane extends into said annular space.

3. A compressor of the rotary vane type as claimed in claim 1, wherein said rotor is formed at an axial end face thereof with an annular groove for maintaining bottom portions of said vane slots in communication with one another such that said vane slots are positioned perpendicular to said annular groove whereby said annular groove is in contact with the bottom openings of said vane slots.

4. A compressor of the rotary vane type as claimed in claim 3 further comprising a suction chamber located on one side of the other side cover for drawing a refrigerant of low pressure from a refrigeration cycle, and wherein said lubricant supply passage means includes a supply passage formed in said one side cover communicating said high pressure chamber with an annular groove formed at an end face of said rotor on the side of said high pressure chamber.

* * * * *